US006447276B1

(12) United States Patent
Becher

(10) Patent No.: US 6,447,276 B1
(45) Date of Patent: Sep. 10, 2002

(54) TWIN SCREW ROTORS FOR INSTALLATION IN DISPLACEMENT MACHINES FOR COMPRESSIBLE MEDIA

(75) Inventor: Ulrich Becher, Porrentruy (CH)

(73) Assignee: Ateliers Busch SA, Chevenez (CH)

( * ) Notice: Subject to any disclaimer, the term of this patent is extended or adjusted under 35 U.S.C. 154(b) by 0 days.

(21) Appl. No.: 09/807,737

(22) PCT Filed: Oct. 1, 1999

(86) PCT No.: PCT/CH99/00466

§ 371 (c)(1),
(2), (4) Date: Apr. 18, 2001

(87) PCT Pub. No.: WO00/25004

PCT Pub. Date: May 4, 2000

(30) Foreign Application Priority Data

Oct. 23, 1998 (EP) ..... 98811063

(51) Int. Cl.[7] ..... F01C 1/16

(52) U.S. Cl. ..... 418/201.3; 418/201.1; 418/9

(58) Field of Search ..... 418/201.3, 201.1, 418/9

(56) References Cited

U.S. PATENT DOCUMENTS

| | | | | |
|---|---|---|---|---|
| 2,543,894 A | * | 3/1951 | Colombo | |
| 3,807,911 A | | 4/1974 | Caffrey | |
| 5,697,772 A | * | 12/1997 | Kawamura | 418/201.3 |

FOREIGN PATENT DOCUMENTS

| | | | |
|---|---|---|---|
| AU | 261792 | | 6/1963 |
| DE | 87685 | | 6/1895 |
| DE | 594 691 | C | 3/1934 |
| DE | 609405 | | 1/1935 |
| DE | 2434782 | | 2/1975 |
| DE | 2434784 | | 2/1975 |
| DE | 2934065 | A1 | 4/1980 |
| DE | 2944714 | A1 | 5/1981 |
| DE | 3332707 | A1 | 3/1985 |
| DE | 19530662 | A1 | 2/1996 |
| DE | 4445958 | A1 | 6/1996 |
| EP | 0697523 | A2 | 2/1996 |
| SE | 85331 | | 1/1936 |
| WO | WO 97 21926 | A | 6/1997 |

* cited by examiner

*Primary Examiner*—Thomas Denion
*Assistant Examiner*—Theresa Trieu
(74) *Attorney, Agent, or Firm*—Oliff & Berridge, PLC

(57) ABSTRACT

Displacement machines for compressible media having single-threaded, twin screw rotors with continuously decreasing pitch to achieve an inner compression are known. The demand for compact pumps with rotors as short as possible, and the frequent, process-related demand for quick disassembly of the housing, set limits however for the wrapping angle or respectively for the variation of the end profiles, which, in turn, leads to extreme pitch ratios or to insufficient compression rates. The present invention uses screw rotors with an optimized, non-monotone pitch course and alternative end profile variation with constant diameters. Suction capability is improved with the same space requirement, and compression rates of 3.0 and more are achieved easily with only four wraps. Displacement machines equipped with such twin screw rotors provide optimal results with respect to energy requirement, temperature, construction space and servicing with application possibilities in chemistry and in semiconductor technology.

3 Claims, 6 Drawing Sheets

FIG. 8a FIG. 8b FIG. 8c
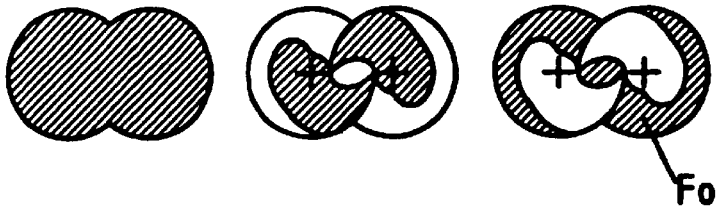
FIG. 9a,b,c
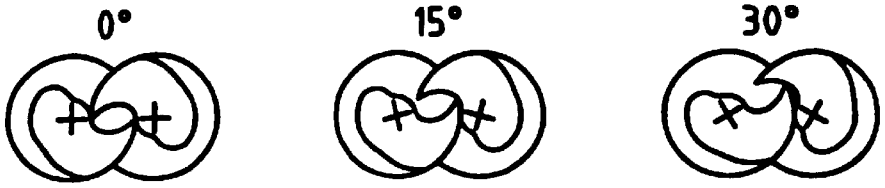
FIG. 9d,e,f
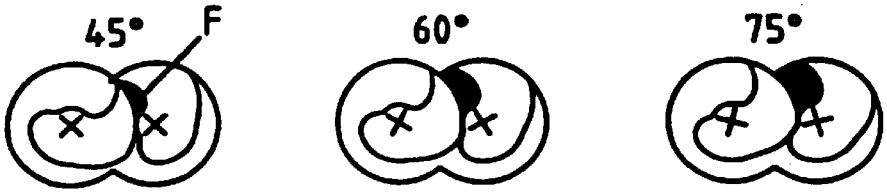
FIG. 9g,h,i
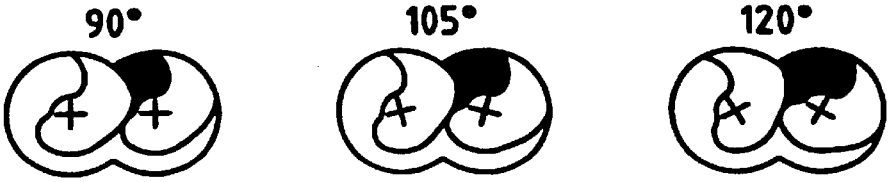
FIG. 9j,k,l
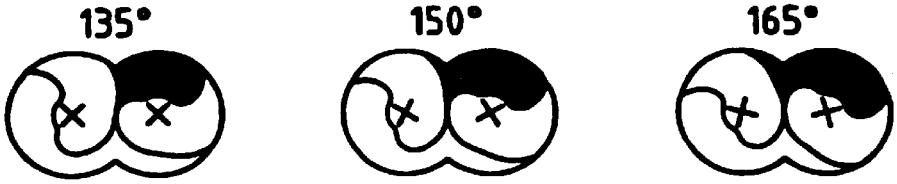
FIG. 9m,n
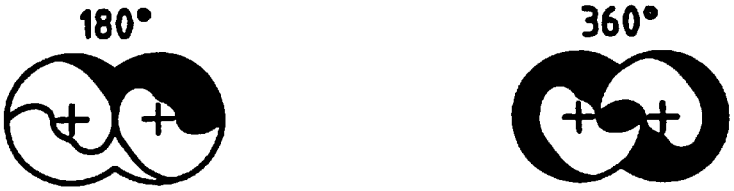
FIG. 9o,p
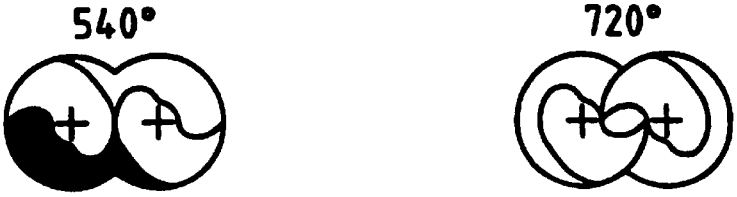

TWIN SCREW ROTORS FOR INSTALLATION IN DISPLACEMENT MACHINES FOR COMPRESSIBLE MEDIA

BACKGROUND OF THE INVENTION

The invention relates to twin screw rotors for installation in displacement machines for compressible media, in particular pumps, which rotors are designed single-threaded with varying pitch and are intended to be in axis-parallel, opposed, outside engagement with wrapping angles of at least 720°, and to form in a housing an axial sequence of chambers without blow-hole connections, the end profile comprising a core arc of a circle, cycloidal hollow flank, an outer arc of a circle and a further flank.

DESCRIPTION OF RELATED ART

The patent DE 87685 shows a machine called a screw wheel capsule mechanism, in which the screw rotors are designed with variable pitch. The machine can be used both as a motor and as a pump. In order to additionally increase the volume of the working chambers in the direction of the expanding medium, when operating as a motor, the rotors are alternatively constructed tapering.

Described in the patent DE 609405 is an air cooling machine with compressor and expander, which both have screw pairs with variable pitch and thread depth. The enveloping surfaces of the rotors are designed tapering.

Both of the aforementioned machines have the drawback that they require tapering cylinders, whereby the rotors can be put in and taken out on one side only. This increases the expenditure (of time and effort) during assembly and disassembly of the machines, which is very disadvantageous in particular during maintenance and repair work.

The patent application EP 0 697 523 concerns a screw-type displacement machine in which the rotors meshing with one another have unequal screw profiles, designated as "male" and "female", so-called S.R.M. profiles with continuous change of the pitch. The end profile is thereby varied in such a way that the angle of the tooth tip, or respectively the length of outer arc is a monotonically increasing function dependent upon the wrapping angle. Such profiles have the drawback that a good partitioning of the axial sequence of working cells is not possible owing to the remaining blow hole. The vacuum losses caused by the blow hole result in losses in degree of efficiency, so that with such a machine no good inner compression is possible at least at low and medium rotational speeds.

The published patent application DE 19530662 discloses a screw suction pump with outer combing screw elements, in which the pitch of the screw elements continuously decreases from their inlet end to their outlet end to cause the compression of the gas to be released. The shape of the teeth of the screw rotor has an epitrochoidal and/or Archimedean curve. This machine has the disadvantage that the achievable inner compression rate with the shown geometric proportions is mediocre. Moreover the lacking end profile variation sets the already not good compression ratio, and leads to an increased leak rate owing to the reduction in the depth of the gap between screw outer diameter and housing toward the screw end.

The published patent application DE 4445958 describes a screw compressor with opposite-running, rotating outer combing screw elements. The threading helices of the screw elements become continuously smaller from one axial end to the second axial end removed therefrom. Proposed as a profile is a rectangular or trapezoidal profile. A drawback of these kinds of geometry for the profile is that they work sufficiently loss-free only if the thread depth is minimal with respect to the diameter, as is explained in the said publication. Such a machine therefore has a large constructional volume and a great weight. It is a further drawback of such profile geometry that extremely high changes in pitch are necessary if a satisfactory inner compression rate is supposed to be achieved. As with the mentioned DE 19530662, the lacking end profile variation here too fixes this shortcoming, and this leads to a high leak rate owing to the reduction of the depth of the gap between screw outer diameter and housing toward the screw end.

Further publications, such as, for example, SE 85331, DE 2434782 and DE 2434784, concern inner-axial screw machines with non-constant pitch of the screws or varying end profiles. These machines all have the drawback that the construction cost is high, and that in each case dynamic seals are also required suction-side.

Furthermore there are some publications, for example DE 2934065, DE 2944714, DE 3332707 and AU 261792, which describe two-shaft compressors with screw-like rotors. There the rotors, and in some cases the housing too, are composed of profile disks of differing thickness and/or contour, disposed axially behind one another, and thus achieve inner compression. All machines with screw-like rotors have the drawback that their degree of efficiency is decreased compared to that of machines with screw-shaped rotors because detrimental spaces and whirl zones arise through the stepped construction. Furthermore problems with respect to shape consistency are to be expected with screw-like rotors since they heat up in operation.

SUMMARY OF THE INVENTION

Starting with this state of the art, the invention has as its object to propose a twin screw rotor which does not have the above-mentioned drawbacks.

These objects are attained, according to the invention, in that the pitch is not monotone and is defined as a variable dependent upon the wrapping angle, in that the pitch in a first section increases from the suction-side screw end, and reaches a maximal value after approximately one turn, in that the pitch in a second section, adjacent to the first section, decreases and reaches a minimal value at approximately one turn before the delivery side screw end, and in that the pitch in a third section, adjacent to the second section, remains substantially constant.

Special embodiments of the invention are described in the dependent claims.

BRIEF DESCRIPTION OF THE DRAWINGS

The invention will be described more closely in the following with reference to the embodiments illustrated in the drawings:

FIGS. 8*a* to 8*c* are housing, rotor and working chamber sections of a compressor provided with rotors according to the invention;

FIGS. 9*a* to 9*p* are frontal sections through a rotor pair, which illustrate the development of the working chamber section according to FIG. 7.

DETAILED DESCRIPTION OF THE INVENTION

Figure 1:
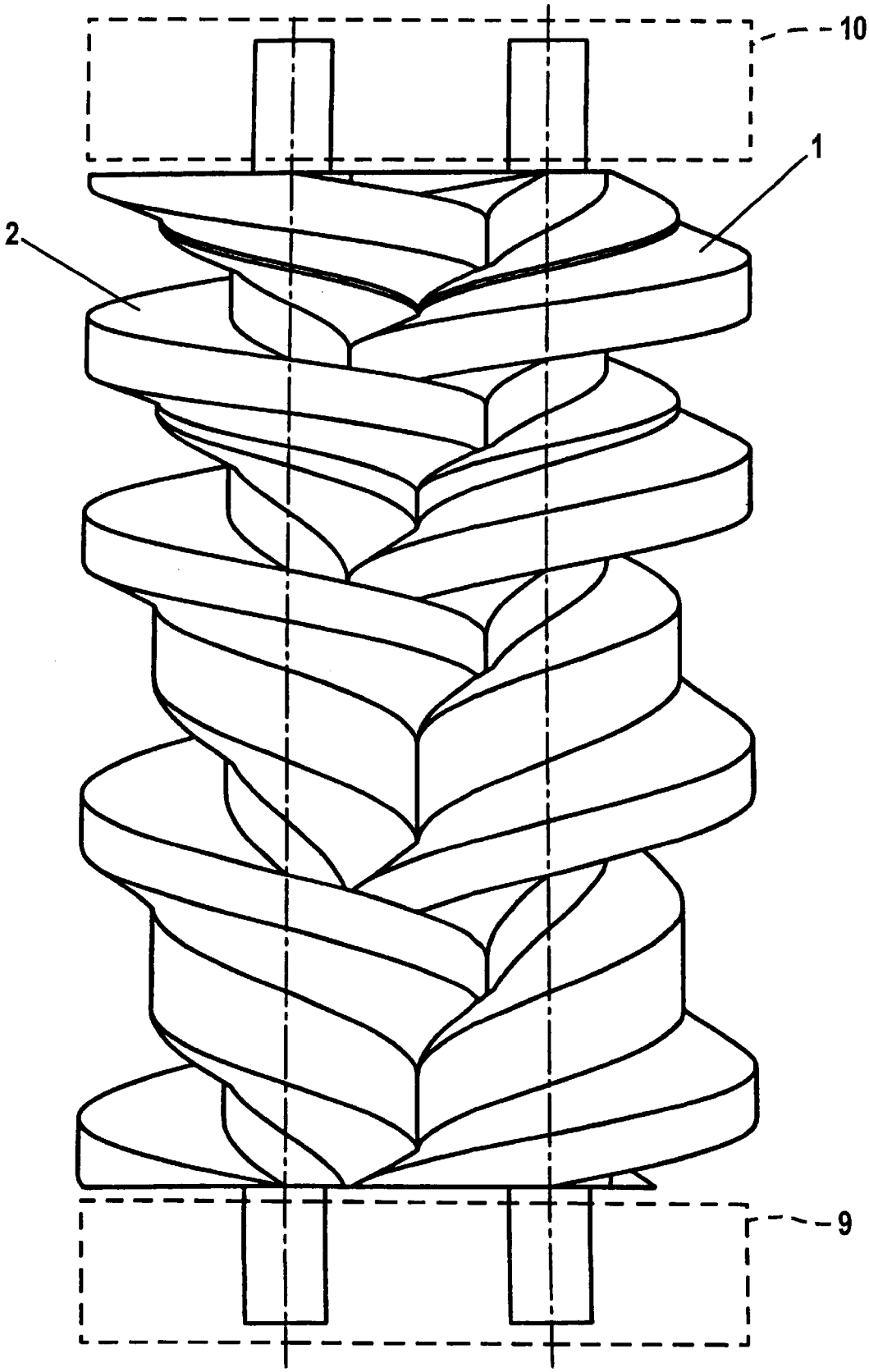
FIG. 1 shows a pair of screw rotors in engagement with one another.
Figure 2:
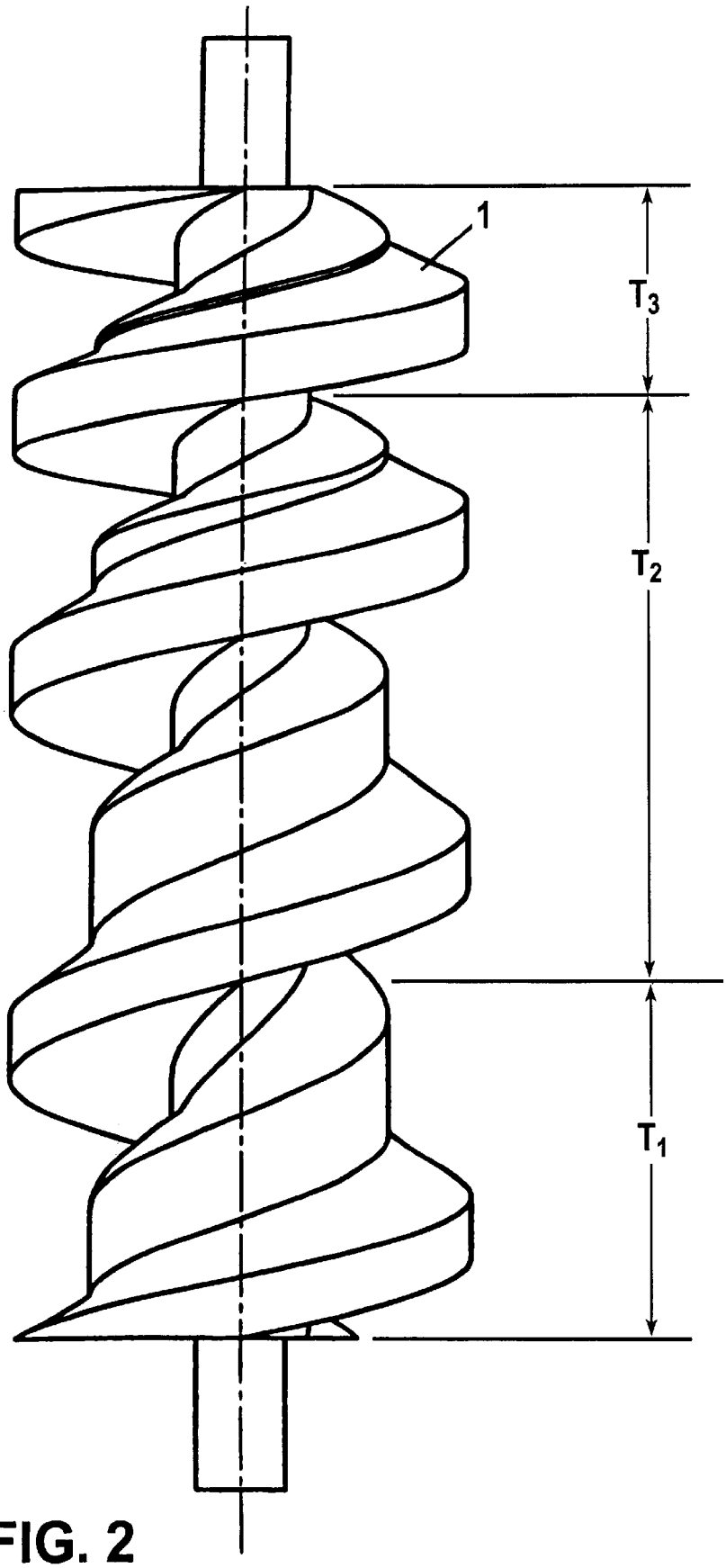
FIG. 2 shows the right-hand rotor.
Figure 3:
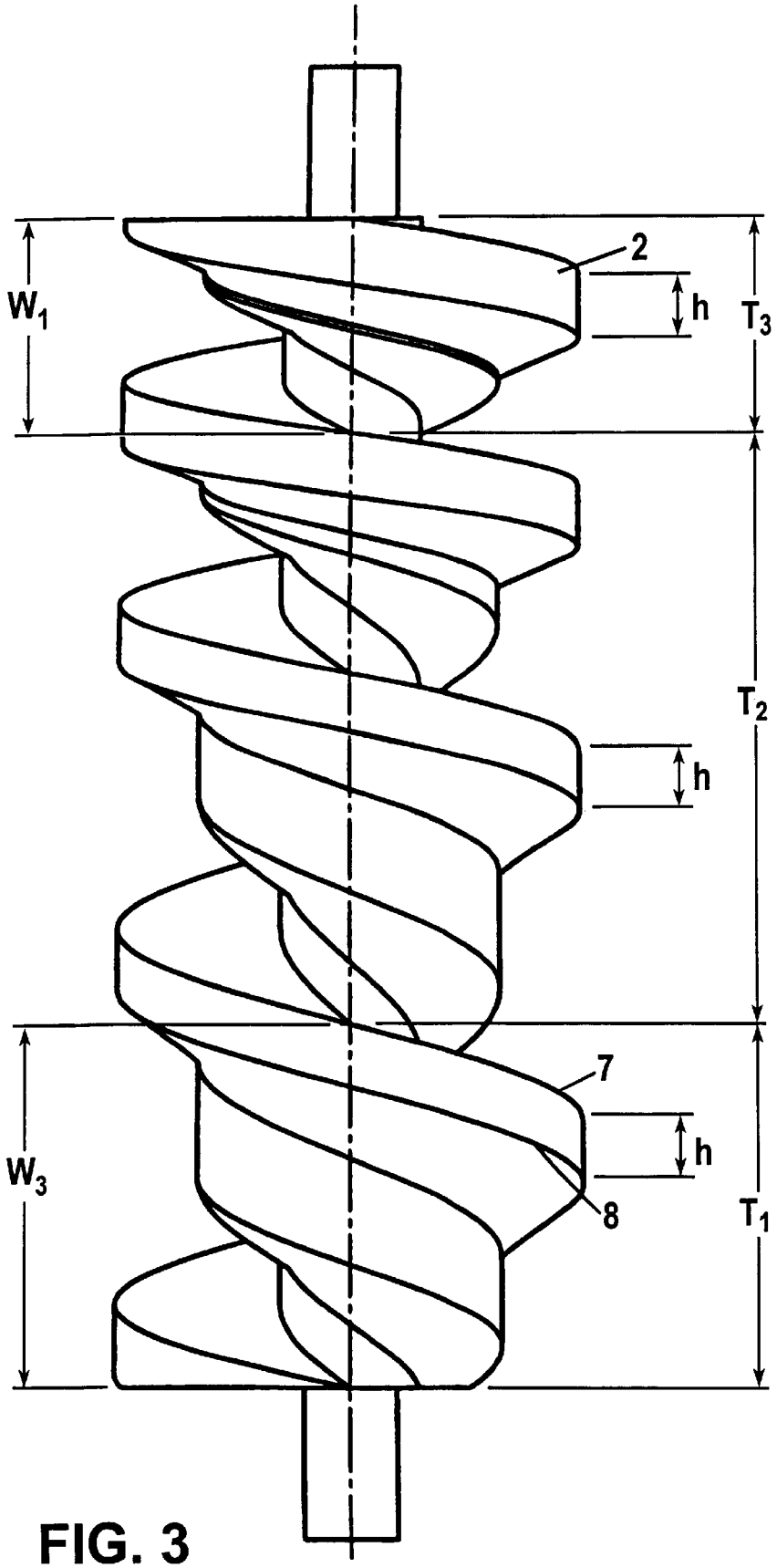
FIG. 3 shows the left-hand rotor.

FIG. 1 shows an embodiment example of a pair of screw rotors 1 and 2 in axis-parallel, outer engagement. FIGS. 2 and 3 show each of the rotors 1 and 2 according to FIG. 1 separately. It is clearly discernible in these figures that the outer casing and the core are cylindrical, and thus the thread depth is constant over the screw length. In FIG. 3 the measurements $\Delta w_1$ and $\Delta w_3$ show that the pitch of the screw varies along the axis, that the height h of the screw-shaped outer cylindrical rotor surface, however, remains thereby constant, whereby leakage losses between rotor and housing inner wall from suction-side screw-end 9 toward the delivery side screw-end 10, as arise undesirably with some of the initially mentioned state-of-the-art machines, are prevented. Designated by the reference number 7 in this figure is the reference spiral, which will be gone into more closely later on, and 8 is the second demarcation spiral of the outer, cylindrical rotor surface.

Figure 4:
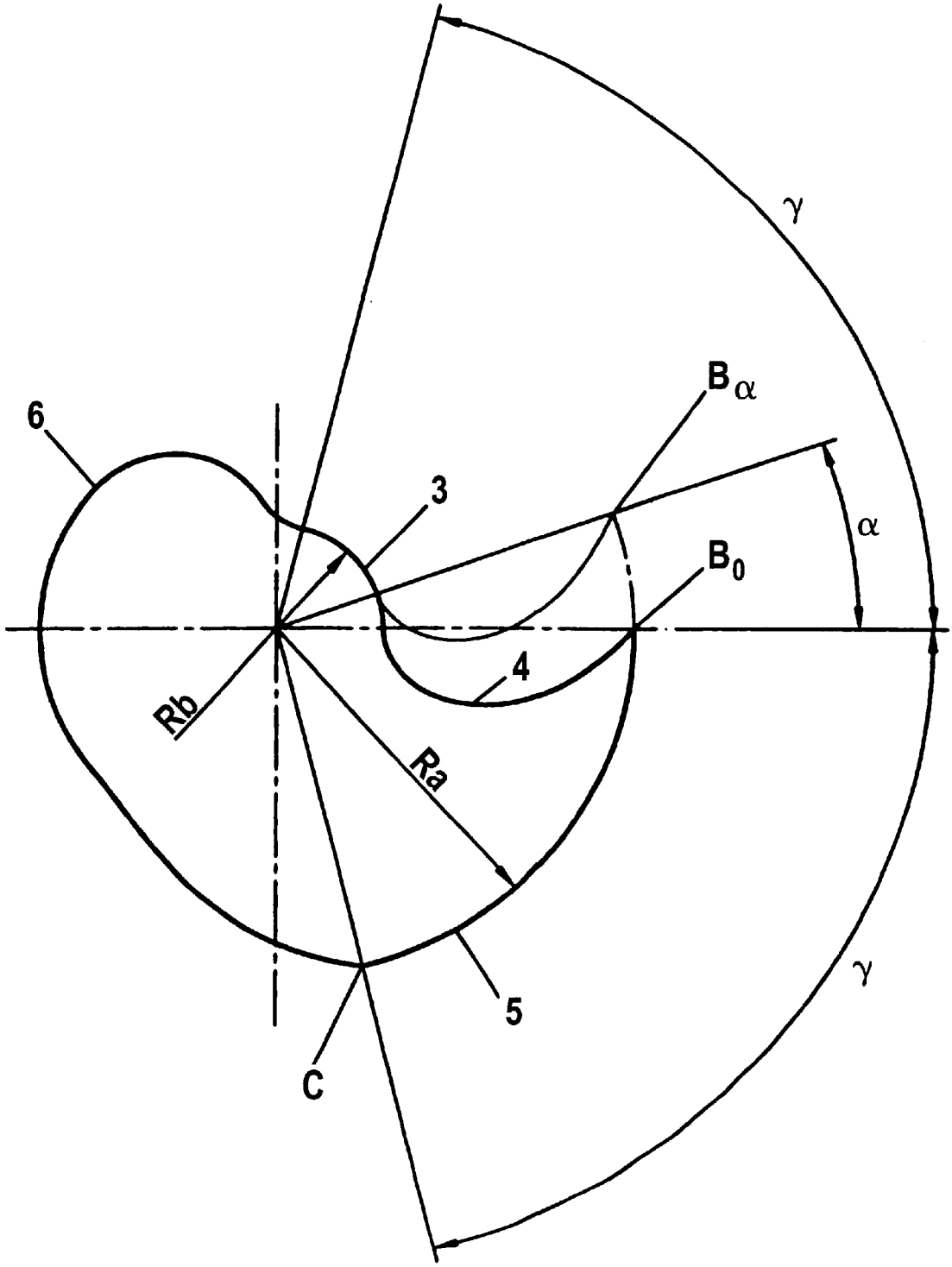
FIG. 4 is a frontal section of a screw rotor with varying profile.

Shown in FIG. 4 is a rotor in a section at right angles to the rotor axis. The thus formed end profile has a core arc of a circle 3 with a constant radius Rb over the entire length of the screw, which—clockwise—after a sector angle $\gamma$, changes into a cycloidal hollow flank 4. The geometry of the hollow flank 4 is unchanged over the entire screw length. Following, with a sharp angle, the hollow flank 4 at point $B_0$ is an outer arc 5 with a constant radius Ra over the entire screw length, which, after a sector angle $\gamma$ at point C, changes into a further flank 6. This comes out finally with a tangential transition into the core arc of a circle 3. The variation of the end profile contour along the screw axis is based on a change of the sector angle $\gamma$ as well as on a change in the geometry of the further flank 6. The variation of the sector angle $\gamma$ along the screw axis is preferably spatially determined through an at least close to equidistant course of a reference spiral (7 in FIG. 3), formed by the outermost points of the hollow flank $B_\alpha$, and the second demarcation spiral (point C) (8 in FIG. 3) of the outer, cylindrical rotor surface.

Figure 5:
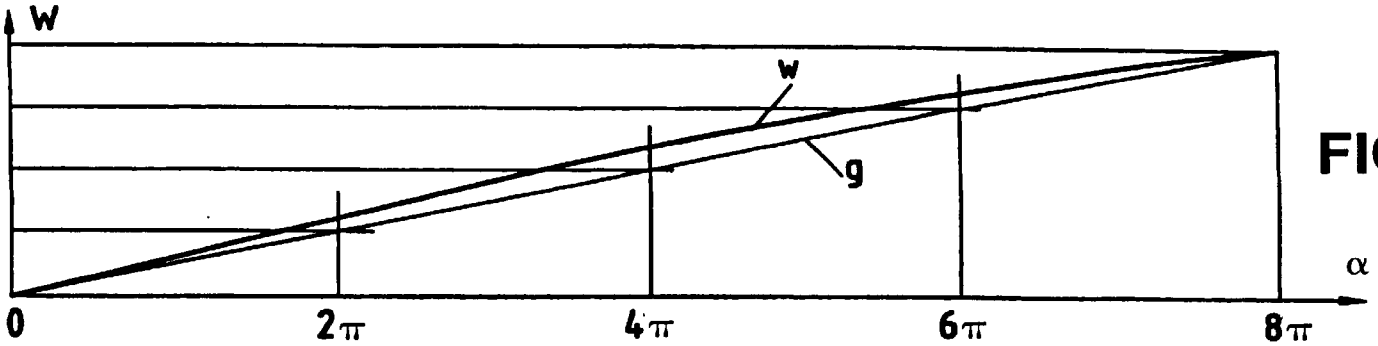
FIG. 5 shows the evolution of the reference spiral of a rotor according to the invention.
Figure 6:
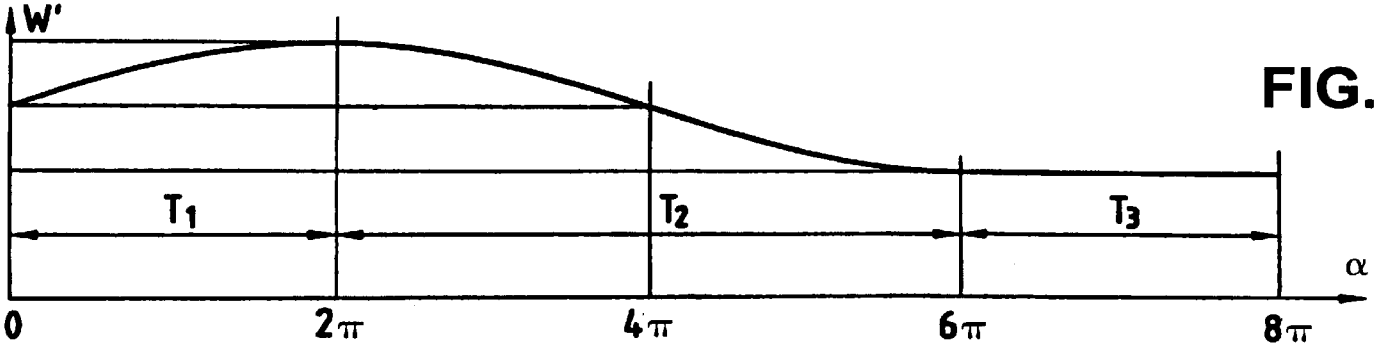
FIG. 6 shows the pitch course of the evolution according to FIG. 5.

FIG. 5 shows in a diagram the evolution w of the reference spiral mentioned in connection with FIG. 4 in dependence upon the wrapping angle $\alpha$. For comparison, a straight line g and corresponding segments $P_0$, $2P_0$, etc., of the evolution of a spiral with constant gradient have been drawn in. The course of the gradient is clearly discernible if one considers the first derivative, presented in FIG. 6, $$w'\left(=\frac{\delta w}{\delta \alpha}\right)$$

of the evolution w. This value w' is the dynamic gradient of the above-mentioned reference spiral. One sees in this figure that the gradient begins at $\alpha=0$ with the value $$\frac{L_0}{2\pi},$$

whereby $L_0$ is a constant corresponding to one of the middle gradient heights. In a first section $T_1$, w' increases, and reaches at $\alpha=2\pi$ the maximal value $$\frac{(1+A)\cdot L_0}{2\pi},$$

whereby A is the amplitude moderator. In the second section $T_2$, which runs from $2\pi$ to $6\pi$, the gradient decreases, and reaches at $\alpha=6\pi$ the minimal value $$\frac{(1-A)\cdot L_0}{2\pi},$$

which it maintains in the third section $T_3$ until the end of the screw.

Figure 7:
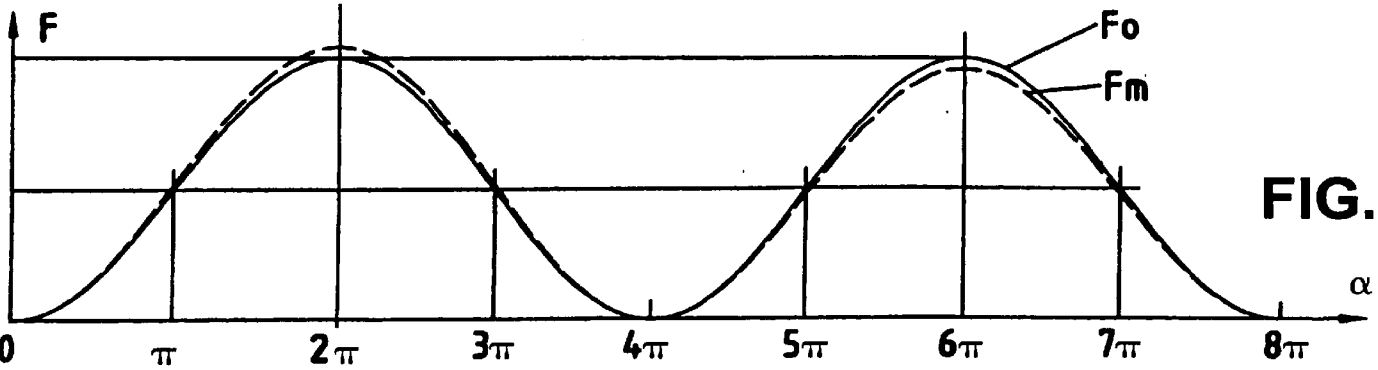
FIG. 7 shows the course of the working chamber section for a machine without and with profile variation.

FIG. 7 shows the chamber cross-section F as a function of the wrapping angle $\alpha$, the curve indicated by an unbroken line $F_0$ showing the chamber cross-section without profile variation and the curve indicated by a broken line $F_m$ showing the chamber cross-section with profile variation.

Shown in FIG. 8*a* is the cross-section of a housing intended to receive twin screw rotors according to the invention. FIG. 8*b* shows a section through the rotors corresponding to the illustration of FIG. 4, and in FIG. 8*c* the chamber cross-section $F_o$ is shown hatched.

Shown in FIGS. 9*a* to 9*p* is, in frontal section, the development of the working chamber cross-section in dependence upon the wrapping angle. The latter is indicated in angular degrees in the figures.

What is claimed is:

1. Twin screw rotors for installation in displacement machines for compressible media, the screw rotors being single-threaded with varying pitch and intended to be in axis-parallel, opposed, outside engagement with wrapping angles of at least 720°, the screw rotors forming in a housing an axial sequence of chambers without blow-hole connections, the twin screw rotors comprising:

an end profile that includes a core arc of a circle, a cycloidal hollow flank, an outer arc of a circle and a further flank; and wherein the pitch of the twin screw rotors is not monotone and is defined as a variable dependent upon the wrapping angle, so that the pitch in a first section increases from a suction-side screw end, and reaches a maximal value after approximately one turn, the pitch in a second section, adjacent to the first section, decreases and reaches a minimal value at approximately one turn before a delivery-side screw end, and so that the pitch in a third section, adjacent to the second section, remains substantially constant.

2. The twin screw rotors according to claim 1, wherein end profile contours along the screw rotor axis vary in that a sector angle of the core arc of a circle and outer arc of a circle change and the geometry of the further flank changes, the core circle radius, the outer circle radius and the geometry of the hollow flank being constant, and the outermost points of the hollow flank forming a reference spiral for definition of a pitch course.

3. The twin screw rotors according to claim 2, wherein the variation of the sector angle of the core arc of a circle and outer arc of a circle along the screw axis is determined by a spatially at least almost equidistant course of the reference spiral and of a second demarcation spiral of the outer, cylindrical rotor surface.

* * * * *